United States Patent [19]

Cranney et al.

[11] Patent Number: 4,678,524

[45] Date of Patent: Jul. 7, 1987

[54] CAST EXPLOSIVE COMPOSITION AND METHOD

[75] Inventors: Don H. Cranney, South Jordan; David L. Gordon, American Fork; Richard H. Hales, West Jordan, all of Utah

[73] Assignee: IRECO Incorporated, Salt Lake City, Utah

[21] Appl. No.: 875,467

[22] Filed: Jun. 18, 1986

[51] Int. Cl.[4] ..... C06B 45/02

[52] U.S. Cl. ..... 149/21; 149/2; 149/44; 149/109.6

[58] Field of Search ..... 149/2, 21, 109.6, 44

[56] References Cited

U.S. PATENT DOCUMENTS

| | | | |
|---|---|---|---|
| 4,525,225 | 6/1985 | Cechanski | 149/46 |
| 4,548,659 | 10/1985 | Jessop | 149/46 |
| 4,566,919 | 1/1986 | Jessop | 149/43 |

*Primary Examiner*—Stephen J. Lechert, Jr.

[57] ABSTRACT

The present invention relates to a cast explosive composition and other energetic compositions such as propellants. (As used herein, the term "explosive" also shall include other energetic compositions such as propellants.) More particularly, the invention relates to a cast explosive composition which is initially formed as a stable, fluid, water-containing, water-in-oil emulsion explosive and which thereafter solidifies upon the addition of a desiccant and/or emulsion destabilizing agent. As used herein, the term "desiccant" means a water reacting, absorbing or adsorbing agent. One method of the present invention is the formulating of the cast explosive composition by adding the desiccant and/or destabilizing agent to a stable emulsion to cause the emulsion to solidify. Alternatively, a desiccant can be included in the aqueous phase of the stable emulsion which then is solidified by the addition of an emulsion destabilizing agent. A further method relates to the loading of a container with the cast explosive composition. As used herein, the terms "cast" and "solidify" refer to an unflowable or relatively unextrudable mass of finely knitted oxidizer salt crystals which have crystallized from an aqueous solution.

36 Claims, No Drawings

CAST EXPLOSIVE COMPOSITION AND METHOD

Water-in-oil emulsion explosives are well known in the art. See, for example, U.S. Pat. No. 4,356,044; 4,322,258; and 4,141,767. Such explosives contain a continuous phase of a water-immiscible organic liquid fuel and a discontinuous phase of an emulsified inorganic oxidizer salt solution. Normally, these explosive compositions contain a density reducing agent for sensitivity purposes. These compositions have a grease-like consistency which renders them water-resistant and generally easily extrudable.

More recently, cast explosive compositions formed from an unstable water-in-oil emulsion have been disclosed. In U.S. Pat. Nos. 4,548,659 and 4,566,919, cast explosive compositions are formulated at an elevated temperature by forming a water-in-oil emulsion, which, when allowed to cool, forms a cast composition due to the weakening or breakdown of the inherently unstable emulsion phase and subsequent crystallization of the oxidizer salt. European Patent Application No. 0152060 suggests that cast compositions can be formed from a stable water-in-oil emulsion by adding a surfactant to cause the breakdown of the emulsion and crystallization of the inorganic oxidizer salt in solution. This patent application, however, pertains to anhydrous water-in-oil emulsions, which are inherently less stable than those containing water.

SUMMARY OF THE INVENTION

The present invention provides a means whereby a cast explosive composition can be formed from a stable water-in-oil emulsion explosive that contains a significant amount of water. This can be accomplished in several ways. A desiccant can be included in the continuous aqueous phase of the stable emulsion, and an emulsion destabilizing agent can be added in an amount sufficient to cause the explosive to solidify. Alternatively, the desiccant and/or emulsion destabilizing agent can be separately or jointly added to the stable emulsion. By "added" is meant to mix the additive throughout the emulsion sufficient to cause the emulsion to breakdown and solidify.

A particular advantage of forming a cast explosive composition according to the present invention is that a stable emulsion explosive can be formulated at an elevated temperature, cooled, and stored or transported as desired, prior to adding the desiccant or emulsion destabilizing agent or both to cause the explosive to solidify. Thus handling of the emulsion at an elevated temperature is minimized. In addition, temperature-sensitive ingredients such as metallic particles or compound explosives can be added to the stable emulsion after it has cooled to ambient temperature but prior to, or at the same time as, the addition of the desiccant and/or destabilizing agent. In this way highly sensitive ingredients can be incorporated into a cast explosive composition at relatively safe temperatures.

DETAILED DESCRIPTION OF THE INVENTION

Prior to the addition of the desiccant and/or destabilizing agent and subsequent solidification, the compositions of the present invention have a grease-like consistency and are in the form of a water-in-oil emulsion. This is advantageous for a number of reasons. The emulsion form allows droplets of aqueous oxidizer salt solution to be finely and intimately dispersed throughout the continuous fuel phase. As the stable emulsion cools from its elevated formulation temperature, precipitation of the salts within the small droplets is physically inhibited. Thus the intimate dispersion is maintained which results in increased reactivity between oxidizer and fuel. Even upon the destabilization of the emulsion and subsequent crystallization of the salts, the intimacy of oxidizer and fuel dispersion is largely maintained. Another advantage is that prior to destabilization, the grease-like emulsion is fluid and can be pumped, extruded or further mixed as desired. Thus temperature-sensitive ingredients, such as compound explosives, can be added to and mixed throughout the composition at a temperature (normally ambient) below the elevated formulation temperature of the emulsion, and thus at a temperature at which the sensitive ingredients can be added safely. Further advantages are that by cooling the emulsion prior to casting, shrinkage and/or cavity formation after placement into a container can be minimized and containers need not be cooled as in typical melt cast operations. Still further, the risks to personnel associated with the handling of high temperature material can be reduced.

A preferred ingredient of the present invention is a desiccant, which will react with, absorb or adsorb the water in the aqueous phase of the emulsion, upon destabilization of the emulsion. This interaction thereby contributes to the desired cast characteristics of the final product. Preferably, sufficient desiccant is included to hydrate substantially all of the water in the composition.

The desiccant preferably is present in an amount of from about 0.5% by weight of the total composition to about 15% and can be selected from (1) nitrate, perchlorate, chlorate, sulfate, hydrogen sulfate and chloride salts of various metals including but not limited to magnesium, calcium, aluminum, sodium, lithium, zinc, iron and copper, (2) various other anion/cation salts such as phosphates, carbonates and acetates, (3) various dessicants that depend on physical absorption such as silica, alumina and charcoal, or (4) metallic oxides, such as magnesium and calcium oxide, which can act directly as desiccants or can be reacted in situ, i.e., with acids, water or by metathesis, to form desiccating salts, and (5) materials which react with water such as acid anhydrides, acid halides, isocyanates and esters.

The inorganic oxidizer salt is employed in an amount of from about 35% to about 95% by weight of the total composition. The oxidizer salt(s) can be selected from ammonium, alkali and alkaline earth metal nitrates, chlorates and perchlorates or mixtures thereof. The oxidizer salt preferably is primarily ammonium nitrate (AN) but other salts may be employed as well. If AN is used as the primary salt, then other salts preferably are used in an amount of up to about 20%. From about 10% to about 65% of the total oxidizer salt may be added in particle or prill form.

The immiscible organic liquid fuel forming the continuous phase of the composition at the time of its formulation at an elevated temperature, and prior to solidification, is present generally in an amount of from about 2% to about 15% or more by weight of the total composition. The actual amount used can be varied depending upon the particular immiscible fuel(s) used and upon the presence of other fuels, if any, and upon the intended application of the product. The immiscible organic liquid fuels can be aliphatic, alicylic and/or aromatic, can be saturated and/or unsaturated, and can be polymeric or polymerizable, so long as they are liquid at the formulation temperature. Preferred fuels include mineral oil, waxes, paraffin oils, benzene, toluene, xylenes and mixtures of liquid hydrocarbons generally referred to as petroleum distillates such as gasoline, kerosene and diesel fuel. Particularly preferred liquid fuels are mineral oil, No. 2 fuel oil, paraffin waxes, microcrystalline waxes and mixtures thereof. Aliphatic and aromatic nitro-compounds also can be used. Halogenated organic materials can be used in amounts up to about 25%. Mixtures of the above can be used.

Water is employed as an essential ingredient and functions as a solvent in the oxidizer salt solution in an amount of from at least about 1% to about 10% by weight of the emulsion phase, and preferably in an amount of from about 3% to about 10%, since the emulsion tends to be more stable at higher water contents. Water miscible organic liquids can partially replace water as a solvent for the salts, and such liquids also function as a fuel for the composition. Miscible liquid fuels can include alcohols such as methyl alcohol, glycols such as ethylene glycol, amides such as formamide, and analogous nitrogen-containing liquids. The use of water allows for a lower formulation temperature since it lowers the crystallization temperature of the oxidizer salt solution. Water also increases the stability of the emulsion until such time as the emulsion intentionally is destabilized and the composition solidified. It is because of the presence of water that the desiccant preferably is employed to bind the water and enhance the solid characteristics of the final composition.

Optionally, and in addition to the immiscible liquid organic fuel, solid or other liquid fuels or both can be employed in selected amounts. Examples of solid fuels which can be used are finely divided aluminum particles; finely divided carbonaceous materials such as gilsonite or coal; finely divided vegetable grain such as wheat; and sulfur. Liquid fuels include those water-immiscible fuels described above. A particularly preferred solid fuel is particulate aluminum which can be employed in amounts up to about 50% by weight to increase the density and energy of the composition. Although granular, atomized or paint grade aluminum can be used, atomized is preferred.

Sensitizers can be employed to increase the compositions' sensitivity to detonation. They can be liquid or solid and can comprise compound explosives, particulate metals such as aluminum and mixtures of these ingredients. Particulate aluminum can be used in amounts up to about 50% by weight, and compound or molecular explosives may be used in an amount up to about 70% by weight. Examples of particulate compound explosives are pentaerythritol tetranitrate (PETN), cyclotrimethylene trinitramine (RDX), trinitrotoluene (TNT), cyclotetramethylene tetranitramine (HMX), and nitrocellulose. Other types of compound explosives are water soluble salts such as amine nitrates or perchlorates, including monomethylamine or ethylenediamine nitrates, and alkanolamine salts such as ethanolamine nitrate or perchlorate. A preferred sensitizer is RDX, alone or in combination with atomized aluminum.

The emulsion destabilizing agent is any agent that will cause destabilization of the emulsion so that solidification can occur and generally is employed in an amount of from a trace to about 15% by weight of the total composition. Emulsion solidification can be caused by disruption of the emulsion structure either chemically or physically. Chemical disruption of the emulsion by surface active liquids or solids or by various solvents is thought to cause alterations in the interfacial structure of the emulsion, thus allowing oxidizer droplets to coalesce and subsequent crystallization to occur. Another possible form of chemical disruption is that some surface active agents may cause a gradual inversion of the water-in-oil emulsion to an oil-in-water emulsion, thus allowing crystallization to occur. Physical disruption of the emulsion structure by particulate matter, which can serve as nucleation sites for crystal growth, is another possible mechanism. Such particulates may also be surface active so that a combination of mechanisms may be involved. Examples of the emulsion destabilizing agent are (1) various ionic surfactants, typically oil-in-water surfactants, including: ethoxylated or nonethoxylated alkyl, aryl or alkyl aryl sulfonates, such as sodium alkyl naphthalene sulfonate; phosphates; carboxylates and amines; (2) various alkyl, aryl or alkyl aryl nonionic or ethoxylated nonionic surfactants such as ethoxylated alkyl phenols; (3) various surface active solids such as clays, aluminas and silicas and (4) various solvents such as alcohols, ethers, esters, ketones and organic acids. Such agent(s) can be added in any amount necessary to cause destabilization, but generally this amount is less than 10% by weight.

The emulsifier of the present invention can be selected from those conventionally employed, and various types are listed in the above-referenced patents. The emulsifier is employed in an amount of from about 0.2% to about 5% by weight. It preferably is employed in an amount of from about 1% to about 3%. Typical emulsifiers include sorbitan fatty acid esters, glycol esters, substituted oxazolines, alkyl amines or their salts, derivatives thereof and the like. Preferably the emulsifier contains an unsaturated hydrocarbon chain as its lipophilic portion, although the saturated form also can be used.

Although it is desirable that the compositions of the present invention have a high density, the compositions can be reduced from their natural densities by addition of a density reducing agent, such as small hollow particles of which plastic or glass spheres and perlite are examples. In addition, gas bubbles can be entrained into the composition during formulation or can be introduced by a small amount of a chemical gassing agent, such as sodium nitrite, which reacts chemically in the composition to produce gas bubbles. The use of density reducing agents to increase sensitivity is well known in the art.

The compositions of the present invention are formulated by first forming an aqueous solution of the oxidizer salt(s) at an elevated temperature above the salt crystallization or solidification temperature. Optionally a desiccant can be included in the aqueous solution. This solution then is combined with a solution of the emulsifier and the immiscible organic liquid fuel, which can be at ambient or an elevated temperature, and mixed with sufficient vigor to produce an emulsion of the oxidizer salt solution in a continuous organic liquid fuel phase. Usually this can be accomplished essentially instantaneously with sufficient shearing. Shearing should be continued until the formulation is uniform. It is advantageous to predissolve the emulsifier in the organic liquid fuel prior to adding the organic liquid fuel to the oxidizer salt melt or solution. This method allows the emulsion to form quickly and with minimum agitation. The emulsifier can be added separately and just prior to emulsification, however, if desired or if, for example, the emulsifier would degrade at the elevated temperature of the fuel. Solid, particulate fuels and/or oxidizer salts and other ingredients, if any, may be added and mixed throughout the formulation by conventional means. Preferably, such solid ingredients are added just prior to casting. The formulation process also can be accomplished in a continuous manner as is known in the art. The emulsion once formed is stable and remains stable even upon cooling to ambient temperature. The addition of the desiccant and/or emulsion destabilizing agent causes the emulsion to weaken or breakdown, which allows the oxidizer salt to crystallize into a finely knitted crystalline matrix thereby causing solidification of the composition. The time required for solidification or casting can be varied by the selection of desiccant and/or emulsion destabilizing agent, the amounts and combinations thereof, and the manner in which the emulsion is formed. The time can vary from essentially instantaneous to several days. Any temperature-sensitive ingredients such as compound explosives preferably are added with the desiccant and/or emulsion destabilizing agent after the stable emulsion has cooled to a desired temperature. Cooling equipment can be used to accelerate the cooling process.

Reference to the following Tables further illustrates the invention. The examples illustrate the use of various desiccants (for example, magnesium nitrate, magnesium sulfate and magnesium perchlorate), desiccants in the aqueous solution (Examples I, J, K, L and M), various emulsion destabilizing agents (ethoxylated nonyl phenol, and sodium alkyl naphthalene sulfonate), and various combinations thereof with various other ingredients.

The compositions of the present invention can be used in explosive applications requiring relatively insensitive blasting agents in large diameters or bulk configurations. They also can be formulated to be cap sensitive and/or detonable in small diameters. Because the compositions are extrudable and/or pumpable when initially formulated, they can be loaded into containers of various forms for various applications.

While the present invention has been described with reference to certain illustrative examples and preferred embodiments, various modifications will be apparent to those skilled in the art, and any such modifications are intended to be within the scope of the invention as set forth in the appended claims.

TABLE I

| Composition Ingredients (Parts by Weight) | A | B | C | D | E | F | G | H |
|---|---|---|---|---|---|---|---|---|
| Emulsion Ingredients | | | | | | | | |
| AN | 62.62 | 66.27 | 67.05 | 55.07 | 50.40 | 68.69 | 68.40 | 67.65 |
| Sodium nitrate (SN) | 15.05 | 16.57 | 16.60 | 13.63 | 12.48 | 17.00 | 17.10 | 16.91 |
| Water | 5.85 | 4.36 | 4.41 | 3.62 | 3.31 | 4.51 | 4.50 | 4.45 |
| Emulsifier (sorbitan monooleate) | 1.23 | 1.11 | 1.35 | 1.11 | 1.08 | 1.38 | 1.54 | 1.14 |
| Mineral oil | 4.87 | 4.45 | 5.38 | 4.42 | 4.32 | 5.51 | 4.62 | 4.54 |
| Added Ingredients | | | | | | | | |
| Sodium alkyl napthalene sulfonate | 4.49 | 1.93 | 2.37 | 1.95 | 1.79 | — | — | 1.93 |
| Ethoxylated nonyl phenol | — | — | — | — | — | — | 0.96 | — |
| Magnesium sulfate | 5.89 | 1.93 | — | — | 3.23 | — | — | — |
| Magnesium perchlorate | — | — | 2.84 | — | — | 2.91 | — | — |
| Microballoons | — | 3.38 | — | 4.63 | 2.25 | — | 2.88 | 3.38 |
| AN prill | — | — | — | — | 21.14 | — | — | — |
| Ammonium perchlorate (AP) | — | — | — | 15.57 | — | — | — | — |
| Properties | | | | | | | | |
| Density (g/cc) | 1.49 | ~1.20 | 1.49 | 1.50 | ~1.15 | 1.49 | 1.16 | ~1.20 |
| Emulsion Stability (days) | >10 | >14 | >6 | >6 | >3 | >6 | >14 | >14 |
| Casting Time (hours) | 0.7 | ~0.6 | 0.08 | 2.0 | ~0.4 | <96 | ~1.5 | ~1.0 |
| Detonation Results Minimum Booster[1] (det/fail) Velocity (km/sec) | — | 2A/— | — | — | 2A/40 g | — | — | 2A/40 g |
| Diameter (mm) | | | | | | | | |
| 150 | — | 3.7 | — | — | 4.3 | — | 5.7 | — |
| 125 | — | — | — | — | 3.3 | — | — | 3.1 |

[1]2A = 170 g pentolite booster, 40 g = 40 g pentolite booster

TABLE II

| Composition Ingredients (Parts by Weight) | I | J | K | L | M | N |
|---|---|---|---|---|---|---|
| Emulsion Ingredients | | | | | | |
| AN | 64.99 | 63.16 | 63.51 | 48.05 | 41.64 | 44.46 |
| SN | 16.25 | 15.79 | 15.88 | 12.01 | 10.41 | 11.02 |
| Calcium nitrate | — | — | 4.39 | — | — | — |
| Magnesium nitrate | 6.32 | 6.20 | — | 4.67 | 4.05 | — |
| Hexamethylenetetramine | — | — | — | — | — | 3.88 |
| Water | 4.61 | 4.43 | 4.18 | 3.41 | 2.95 | 2.92 |
| Nitric acid | — | — | — | — | — | 1.77 |
| Emulsifier (sorbitan monooleate) | 1.44 | 1.78 | 1.10 | 1.94 | 1.68 | 0.84 |

TABLE II-continued

| Composition Ingredients (Parts by Weight) | I | J | K | L | M | N |
|---|---|---|---|---|---|---|
| Mineral oil | 5.79 | 5.63 | 4.40 | 4.47 | 3.88 | 3.37 |
| Added Ingredients | | | | | | |
| Sodium alkyl naphthalene sulfonate | — | — | 2.34 | — | — | 1.60 |
| Ethoxylated nonyl phenol | 0.60 | 0.58 | — | 0.45 | 0.39 | — |
| Magnesium sulfate | — | — | 4.20 | — | — | 2.79 |
| Microballoons | — | 2.43 | — | — | — | 2.91 |
| AP | — | — | — | — | — | 24.44 |
| PETN | — | — | — | 25.0 | — | — |
| TNT | — | — | — | — | 35.0 | — |
| Properties | | | | | | |
| Density (g/cc) | 1.48 | 1.20 | ~1.50 | 1.52 | 1.54 | 1.18 |
| Emulsion Stability (days) | >15 | >11 | >14 | 30 | 30 | >12 |
| Casting Time (hours) | 4.0 | 6.0 | 48.0 | 6.0 | 6.0 | 12.0 |
| Detonation Results Minimum Booster[1] (det/fail) Velocity (km/sec) Diameter (mm) | — | 3C/— | — | 4.5 g/#12 | — | 2A/40 g |
| 150 | — | 4.8 | — | 6.2 | — | Det |
| 125 | — | — | — | 5.9 | 5.8 | — |
| 100 | — | — | — | 5.6 | 5.5 | — |
| 75 | — | — | — | 5.5 | Fail | — |
| 62 | — | — | — | 5.5 | — | — |
| 50 | — | — | — | 5.8 | — | — |
| 38 | — | — | — | 5.3 | — | — |

[1]3C = 340 g pentolite booster, 4.5 g = 4.5 g pentolite booster, #12 = #12 blasting cap

What is claimed is:

1. A method of formulating a cast explosive composition comprising forming a stable, fluid, water-containing, water-in-oil emulsion explosive and adding a desiccant in an amount sufficient to cause the emulsion explosive to solidify.

2. A method of formulating a cast explosive composition comprising (a) forming a stable, fluid, water-containing, water-in-oil emulsion explosive having a continous oil phase and a discontinuous aqueous phase and containing a desiccant dissolved in the discontinous aqueous phase and (b) adding an emulsion destabilizing agent in an amount sufficient to cause the emulsion explosive to solidify.

3. A method of formulating a cast explosive composition comprising forming a stable, fluid, water-containing, water-in-oil emulsion explosive and adding a desiccant and an emulsion destabilizing agent in amounts sufficient to cause the emulsion explosive to solidify.

4. A method of formulating a cast explosive composition comprising forming a stable, fluid, water-containing, water-in-oil emulsion explosive and adding an emulsion destabilizing agent in an amount sufficient to cause the emulsion explosive to solidify.

5. A method according to claims 1, 2 or 4 wherein the emulsion explosive is formulated at an elevated temperature and allowed to cool prior to adding the desiccant or emulsion destabilizing agent.

6. A method according to claim 3 wherein the emulsion explosive is formulated at an elevated temperature and allowed to cool prior to adding the desiccant and emulsion destabilizing agent.

7. A method according to claims 1, 2, 3 or 4 wherein the emulsion explosive has an emulsion phase comprising an aqueous solution of inorganic oxidizer salt, organic fuel, and a water-in-oil emulsifier.

8. A method according to claim 7 wherein the desiccant is a metallic nitrate, perchlorate, chlorate, sulfate, hydrogen sulfate, chloride, phosphate, carbonate or acetate salt; silica, alumina or charcoal; magnesium or calcium oxide; or an acid anhydride, acid halide, isocyanate or ester.

9. A method according to claims 1, 2, 3 or 4 wherein the cast explosive composition contains a particulate fuel.

10. A method according to claim 9 wherein the particulate fuel is metallic or carbonaceous particles.

11. A method according to claims 1, 2, 3 or 4 wherein the cast explosive composition contains particulate oxidizer salt.

12. A method according to claims 1, 2, 3 or 4 wherein the cast explosive composition contains a sensitizer.

13. A method according to claim 12 wherein the sensitizer is a compound explosive.

14. A method according to claim 13 wherein the emulsion explosive is formulated at an elevated temperature and allowed to cool prior to adding the compound explosive.

15. A method according to claim 12 wherein the sensitizer is hollow particles, entrained gas or gas generated in situ.

16. A method according to claim 7 wherein the water is present in an amount of at least 1% by weight of the emulsion phase to about 10%.

17. A method according to claims 2, 3 or 4 wherein the emulsion destabilizing agent is alkyl, aryl or alkyl aryl sulfonates, phosphates, carboxylates, amines, alcohols, polyalcohols, esters and amides or ethoxylated derivatives thereof; clays, aluminas or silicas; or alcohols, ethers, esters, ketones or organic acids.

18. A method of loading a container with a cast explosive composition comprising first forming at an elevated temperature a stable, fluid, water-containing, water-in-oil emulsion explosive; allowing or causing the emulsion explosive to cool; then adding and mixing throughout the emulsion explosive a desiccant and/or emulsion destabilizing agent in an amount sufficient to cause the emulsion explosive to solidify; and loading the container with the emulsion explosive before the desiccant and/or emulsion destabilizing agent cause the emulsion explosive to solidify.

19. A method of loading a container with a cast explosive composition comprising first forming at an elevated temperature a stable, fluid, water-containing, water-in-oil emulsion explosive having a continous oil phase and a discontinuous aqueous phase and containing a desiccant dissolved in the aqueous phase; allowing the emulsion explosive to cool to ambient temperature; then adding and mixing throughout the emulsion explosive an emulsion destabilizing agent; and then loading the container with the emulsion explosive before the emulsion destabilizing agent and desiccant cause the emulsion explosive to solidify.

20. A cast explosive composition formed from a stable, fluid water-in-oil emulsion explosive comprising inorganic oxidizer salt, water, organic fuel, a water-in-oil emulsifier and a desiccant in an amount sufficient to cause the emulsion explosive to solidify.

21. A cast explosive composition formed from a stable, fluid water-in-oil emulsion explosive comprising inorganic oxidizer salt, water, organic fuel, a water-in-oil emulsifier and an emulsion destabilizing agent in an amount sufficient to cause the emulsion explosive to solidify.

22. A cast explosive composition according to claims 20 or 21 wherein the inorganic oxidizer salt is ammonium, alkali and alkaline earth metal nitrates, chlorates, perchlorates or mixtures thereof.

23. A cast explosive composition according to claim 20 including an emulsion destabilizing agent.

24. A cast explosive composition according to claims 21 or 23 wherein the emulsion destabilizing agent is alkyl, aryl or alkyl aryl sulfonates, phosphates, carboxylates, alcohols, polyalcohols, esters, amides, acids, amines or ethoxylated derivatives thereof; clays, aluminas or silicas; or alcohols, ethers, esters, ketones or organic acids.

25. A cast explosive composition according to claims 20 or 21 wherein the organic fuel is mineral oil, paraffin oils and waxes, microcrystalline waxes or fuel oil and other organic distillates.

26. A cast explosive composition according to claims 8 or 19 wherein the emulsifier is sorbitan fatty acid esters, glycol esters, substituted oxazolines, alkyl amines or their salts or derivatives thereof.

27. A cast explosive composition according to claim 20 wherein the desiccant is a metallic nitrate, perchlorate, chlorate, sulfate, hydrogen sulfate, chloride, phosphate, carbonate or acetate salt; silica, alumina or charcoal; magnesium or calcium oxide; or acid anhydride, acid halide, isocyanate or ester.

28. A cast explosive composition according to claims 20 or 21 including a particulate fuel.

29. A cast explosive composition according to claim 28 wherein the particulate fuel is metallic or carbonaceous particles.

30. A cast explosive composition according to claim 29 wherein the metallic particles are aluminum.

31. A cast explosive composition according to claims 20 or 21 including particulate inorganic oxidizer salt.

32. A cast explosive composition according to claims 20 or 21 including a sensitizer.

33. A cast explosive composition according to claim 32 wherein the sensitizer is a compound explosive.

34. A cast explosive composition according to claims 20 or 21 including hollow particles, entrained gas or gas generated in situ as a density reducing agent.

35. A cast explosive composition according to claims 20 or 21 wherein the water is present in an amount of at least 1% by weight.

36. A cast explosive composition formed from a stable, fluid, water-containing, water-in-oil emulsion explosive comprising inorganic oxidizer salt primarily consisting of a nitrate salt or salts in an amount of from about 35% to about 95% by weight of the total composition, water in an amount of from at least about 1% to about 10%, organic fuel in an amount of from about 2% to about 15%, water-in-oil emulsifier in an amount of from about 0.2% to about 5%, a desiccant in an amount of from about 0.5% to about 5% and an emulsion destabilizing agent in an amount of from a trace to about 15%.

* * * * *